US007158933B2

(12) United States Patent
Balan et al.

(10) Patent No.: US 7,158,933 B2
(45) Date of Patent: Jan. 2, 2007

(54) MULTI-CHANNEL SPEECH ENHANCEMENT SYSTEM AND METHOD BASED ON PSYCHOACOUSTIC MASKING EFFECTS

(75) Inventors: Radu Victor Balan, Levittown, PA (US); Justinian Rosca, Princeton, NJ (US)

(73) Assignee: Siemens Corporate Research, Inc., Princeton, NJ (US)

( * ) Notice: Subject to any disclaimer, the term of this patent is extended or adjusted under 35 U.S.C. 154(b) by 941 days.

(21) Appl. No.: 10/143,393

(22) Filed: May 10, 2002

(65) Prior Publication Data

US 2003/0055627 A1 Mar. 20, 2003

Related U.S. Application Data

(60) Provisional application No. 60/290,289, filed on May 11, 2001.

(51) Int. Cl.
*G10L 21/02* (2006.01)
*G10L 19/00* (2006.01)

(52) U.S. Cl. ..... 704/226; 704/200.1; 704/205

(58) Field of Classification Search ..... 704/226, 704/224, 200.1

See application file for complete search history.

(56) References Cited

U.S. PATENT DOCUMENTS 5,574,824 A * 11/1996 Slyh et al. ..... 704/226
5,757,937 A * 5/1998 Itoh et al. ..... 381/94.3
6,549,586 B1 * 4/2003 Gustafsson et al. ..... 375/285
6,647,367 B1 * 11/2003 McArthur et al. ..... 704/226
6,839,666 B1 * 1/2005 Chandran et al. ..... 704/226

OTHER PUBLICATIONS

Wang et al. "Calibration, Optimization, and DSP Implementation of Microphone Array for Speech Processing," Workshop on VLSI Signal Processing, IX, Nov. 1996, pp. 221-230.*

G. Gustafsson, P. Jax, P. Vary, A Novel Psychoacoustically Motivated Audio Enhancement Algorithm Preserving Background Noise Characteristics in ICASSP, p. 397-400, 1998.

* cited by examiner

*Primary Examiner*—V. Paul Harper
(74) *Attorney, Agent, or Firm*—Donald B. Paschburg; F. Chau & Associates, LLC

(57) ABSTRACT

The present invention is generally directed to a system and method for enhancing speech using a multi-channel noise filtering process that is based on psychoacoustic masking effects. A speech enhancement/noise reduction scheme according to the present invention is designed to satisfy the psychoacoustic masking principle and to minimize the signal total distortion by exploiting multiple microphone signals to enhance the useful speech signal at reduced level of artifacts.

22 Claims, 4 Drawing Sheets

MULTI-CHANNEL SPEECH ENHANCEMENT SYSTEM AND METHOD BASED ON PSYCHOACOUSTIC MASKING EFFECTS

CROSS-REFERENCE TO RELATED APPLICATION

This application claims priority to U.S. Provisional Patent Application Ser. No. 60/290,289, filed on May 11, 2001.

TECHNICAL FIELD

The present invention relates generally to a system and method for enhancing speech signals for speech processing systems (e.g., speech recognition). More particularly, the invention relates to a system and method for enhancing speech signals using a psychoacoustic noise reduction process that filters noise based on a multi-channel recording of the speech signal to thereby enhance the useful speech signal at a reduced level of artifacts.

BACKGROUND

In speech processing systems such as speech recognition, for example, it is desirable to remove noise from speech signals to thereby obtain accurate speech processing results. There are various techniques that have been developed to filter noise from an audio signal to obtain an enhanced signal for speech processing. Many of the known techniques use a single microphone solution (see, e.g., "*Advanced Digital Signal Processing and Noise Reduction*", by S. V. Vaseghi, John Wiley & Sons, $2^{nd}$ Edition, 2000).

For example, one approach for speech enhancement, which is based on psychoacoustic masking effects, is proposed in the article by S. Gustafsson, et al., *A Novel Psychoacoustically Motivated Audio Enhancement Algorithm Preserving Background Noise Characteristics*, ICASSP, pp. 397–400, 1998, which is incorporated herein by reference. Briefly, this method uses an observation from human hearing studies known as "tonal masking", wherein a given tone becomes inaudible by a listener if another tone (the masking tone) having a similar or slightly different frequency is simultaneously presented to the listener. A detailed discussion of "tonal masking" can be found, for example, in the reference by W. Yost, *Fundamentals of Hearing—An Introduction*, $4^{th}$ Ed., Academic Press, 2000.

More specifically, for a given speech signal (or more particular, for a given spectral power density), there is a psychoacoustic spectral threshold such that any interferer of spectral power below such threshold becomes unnoticed. In most de-noising schemes, there is a trade off between speech intelligibility (e.g., as measured by an "articulation index" defined in the reference by J. R. Deller, et al., *Discrete-Time Processing of Speech Signals*, IEEE Press, 2000) and the amount of removed noise as measured by SNR (signal-to-noise ratio) (see, the above-incorporated Gustafsson, et al. reference). Therefore, the entire removal of the noise from the speech signal is not necessarily desirable or even feasible.

Other noise reduction schemes that are known in the art employ two or more microphones to provide increased signal to noise ratio of the estimated speech signal. Theoretically, multi-channel techniques provide more information about the acoustic environment and therefore, should offer the possibility for improvement, especially in the case of reverberant environments due to multi-path effects and severe noise conditions known to affect the performance of known single channel techniques. However, the effectiveness of multiple channel techniques for a few microphones is yet to be proven.

For example, known beamforming techniques and, in general, conventional approaches that are based on microphone arrays, may achieve relatively small SNR improvements in the case of a small number of microphones. In addition, some multi-channel techniques may result in reduced intelligibility of the speech signal due to artifacts in the speech signal that are generated as a result of the particular processing algorithm.

Therefore, a speech enhancement system and method that would provide significant reduction of noise in a speech signal while maintaining the intelligibility of such speech signal for purposes of improved speech processing (e.g., speech recognition) would be highly desirable.

SUMMARY OF THE INVENTION

The present invention is generally directed to a system and method for enhancing speech using a multi-channel noise filtering process that is based on psychoacoustic masking effects. A speech enhancement/noise reduction scheme according to the present invention is designed to satisfy the psychoacoustic masking principle and to minimize the signal total distortion by exploiting the multiple microphone signals to enhance the useful speech signal at reduced level of artifacts.

A noise reduction system and method according to the present invention utilizes a noise filtering method that processes a multi-channel recording of the speech signal to filter noise from an input audio/speech signal. A preferred noise filtering method is based on a psychoacoustic masking threshold and calibration parameter (e.g., relative impulse response between the channels). Preferably, the noise is reduced down to the psychoacoustic threshold, but not below such threshold, which results in an estimated filtered (enhanced) speech signal that comprises a reduced level of artifacts. Advantageously, the present invention provides enhanced, intelligible speech signals that may be further processed (e.g., speech recognition) with improved accuracy.

In one aspect of the invention, a method for filtering noise from an audio signal comprises obtaining a multi-channel recording of an audio signal, determining a psychoacoustic masking threshold for the audio signal, determining a filter for filtering noise from the audio signal using the multi-channel recording, wherein the filter is determined using the masking threshold, and filtering the multi-channel recording using the filter to generate an enhanced audio signal.

The method further comprises determining a calibration parameter for the input channels. Preferably, the calibration parameter comprises a ratio of the impulse response of different channels. The calibration parameter is used to compute the filter.

In another aspect, the calibration parameter is determined by processing a speech signal recorded in the different channels under quiet conditions. For example, in one embodiment, the calibration parameter is determined by processing channel noise recorded in the different channels to determine a long-term spectral covariance matrix, and then determining an eigenvector of the long-term spectral covariance matrix corresponding to a desired eigenvalue.

In yet another aspect, the calibration parameter is determined using an adaptive process. In one embodiment, the adaptive process comprises a blind adaptive process. In other embodiments, the adaptive process comprises a non-parametric estimation process using a gradient algorithm or a model-based estimation process using a gradient algorithm.

In another aspect, a noise spectral power matrix is determined using the multi-channel recording, and the signal spectral power is determined using the noise spectral power matrix. The signal spectral power is used to determine the masking threshold, and the noise spectral power matrix is used to determine the filter.

In yet another aspect, the method comprises detecting speech activity in the audio signal, and updating the noise spectral power matrix at times when speech activity is not detected in the audio signal.

These and other objects, features and advantages of the present invention will be described or become apparent from the following detailed description of preferred embodiments, which is to be read in connection with the accompanying drawings.

DETAILED DESCRIPTION OF PREFERRED EMBODIMENTS

The present invention is generally directed to a system and method for enhancing speech using a multi-channel noise filtering process that is based on psychoacoustic masking effects. A speech enhancement system and method according to the present invention utilizes a noise filtering method that processes a multi-channel recording of an audio signal comprising speech to filter the input audio signal to generate a speech enhanced (filtered) signal. A preferred noise filtering method utilizes a psychoacoustic masking threshold and a calibration parameter (e.g., ratio of the impulse response of different channels) to enhance the speech signal. Preferably, the noise is reduced down to the psychoacoustic threshold, but not below such threshold, which results in an estimated (enhanced) speech signal that comprises a reduced and minimal level of artifacts.

It is to be understood that the systems and methods described herein in accordance with the present invention may be implemented in various forms of hardware, software, firmware, special purpose processors, or a combination thereof. Preferably, the present invention is implemented in software as an application comprising program instructions that are tangibly embodied on one or more program storage devices (e.g., magnetic floppy disk, RAM, CD ROM, ROM and Flash memory), and executable by any device or machine comprising suitable architecture.

It is to be further understood that since the constituent system modules and method steps depicted in the accompanying Figures are preferably implemented in software, the actual connections between the system components (or the flow of the process steps) may differ depending upon the manner in which the present invention is programmed. Given the teachings herein, one of ordinary skill in the related art will be able to contemplate these and similar implementations or configurations of the present invention.

Figure 1:
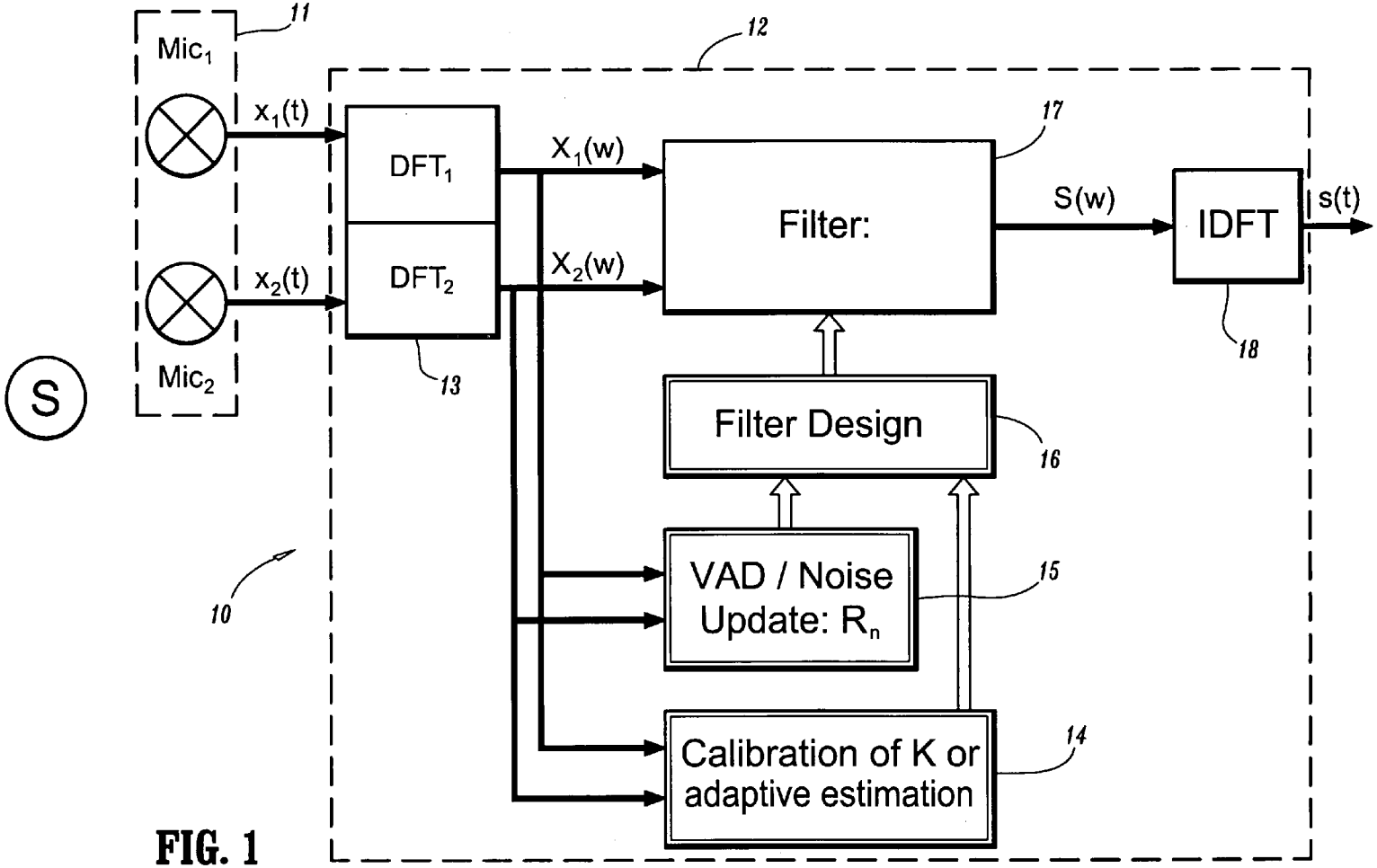
FIG. 1 is a block diagram of a speech enhancement system according to an embodiment of the present invention.

FIG. 1 is a block diagram of a speech enhancement system 10 according to an embodiment of the present invention. The system 10 comprises an input microphone array 11 and a speech enhancement processor 12. For purposes of illustration, the exemplary psychoacoustic noise reduction system 10 comprises a two-channel scheme, wherein a second microphone signal is used to further enhance the useful speech signal at reduced level of artifacts. It is to be understood, however, that FIG. 1 should not be construed as any limitation because a speech enhancement and noise filtering method according to this invention may comprise a multi-channel framework having 3 or more channels. Various embodiments for multi-channel schemes will be described herein.

A multi-channel speech enhancement/noise reduction system (e.g., the dual-channel scheme of FIG. 1) can be used, for example, in real office or car environments. The system can be implemented as a front-end processing component for voice enhancement and noise reduction in a voice communication or speech recognition device. Preferably, a source of interest S is localized, wherein it is assumed that the microphones of microphone array 11 are placed at substantially fixed locations with respect to the speech source S (e.g., the user (speaker) is assumed to be static with respect to the microphones while using the speech processing device). However, adaptive mechanisms according to the present invention can be used to account for, e.g., movement of the source S during use of the system.

The signal processing front-end 12 comprises a sampling module 13 that samples the input signals received from the microphone array 11. In a preferred embodiment, the sampling module 13 samples the input signals in the frequency domain by computing the DFT (Discrete Fourier Transform) for each input channel. The speech processor 12 further comprises a calibration module 14 for determining a calibration parameter K that is used for filtering the input audio signal. In one preferred embodiment, K is an estimate of the transfer function ratios between channels. As explained in further detail below, K may be a static parameter that is determined or set (default parameter) only at initialization, or K may be a dynamic parameter that is determined/set at initialization and then adapted during use of the system 10.

In a speech enhancement/noise reduction system comprising a two-channel framework (wherein a second microphone signal is used to further enhance the useful speech signal at reduced level of artifacts), a mixing model according to an embodiment of the invention is given by:

$$x_1(t)=s(t)+n_1(t) \tag{1}$$

$$x_2(t)=k*s(t)+n_2(t) \tag{2}$$

where $x_1(t)$ and $x_2(t)$ are the measured input signals, s(t)is the speech signal as measured by the first microphone in the absence of the ambient noise, and $n_1(t)$ and $n_2(t)$ are the ambient nose signals, all sampled at moment t.

The sequence k represents the relative impulse response between the two channels and is defined in the frequency domain by the ratio of the measured input signals $X_1^o$, $X_2^o$ in the absence of noise:

$$K(w) = \frac{X_2^o}{X_1^o} \tag{3}$$

Since a speech enhancement method according to the present invention is preferably applied in the frequency domain, the sequence k(t) is defined as the function K(w). Accordingly, in the frequency domain, the mixing model (equations 1 and 2) becomes:

$$X_1(w)=S(w)+N_1(w) \tag{4}$$

$$X_2(w)=K(w)S(w)+N_2(w) \tag{5}$$

The speech processor 12 further comprises a VAD (voice activity detection) module 15 for detecting whether voice is present in a current frame of data of the recorded audio signal. Although any suitable multi-channel voice detection method may be used, a preferred voice detection method is described in the publication by J. Rosca, et al., "Multi-channel Source Activity Detection", In Proceedings of the European Signal Processing Conference, EUSIPCO, 2002, Toulouse, France, which is fully incorporated herein by reference.

Further, in the illustrative embodiment, the voice activity detector module 15 determines a noise spectral power matrix $R_n$, which is used in a noise filtering process. In one embodiment, the noise spectral power matrix $R_n$ is dynamically computed and updated. In accordance with the present invention, an ideal noise spectral power matrix (for a two channel framework) is defined by:

$$\hat{R}_n = E\begin{bmatrix} N_1 \\ N_2 \end{bmatrix}[\overline{N}_1 \quad \overline{N}_2] \tag{6}$$

where E is the expectation operator. In one embodiment of the invention, the ideal noise spectral power matrix is estimated using the frequency domain representation of the input signals $X_1(w)$and $X_2(w)$ as follows:

$$R_n^{new} = (1-\alpha)R_n^{old} + \alpha\begin{bmatrix} X_1 \\ X_2 \end{bmatrix}[\overline{X_1 X_2}] \tag{6a}$$

wherein $R_n^{new}$ denotes an updated noise spectral power matrix that is estimated using the old (last computed) noise spectral power matrix $R_n^{old}$, and wherein $\alpha$ denotes a learning rate, which is a predefined experimental constant that is determined based on the system design. In a two-channel system such as depicted in FIG. 1, a preferred value is $\alpha$=0.1.

When voice is not detected in the current frame of data, the VAD module 15 will update the noise spectral power matrix $R_n$ using equation (6a), for example. Other methods for determining the noise spectral power matrix are described below.

The speech enhancement processor 12 further comprises a filter parameter module 16, which determines filter parameters that are used by filter module 17 to generate an enhanced/filtered signal S(w) in the frequency domain. An IDFT (inverse discrete Fourier transform) module 18, transforms the frequency domain representation of the enhanced signal S(w) into a time domain representation s(t). Various methods according to the invention for filtering a multi-channel recording using estimated filter parameters will be described in detail below.

Figure 2:
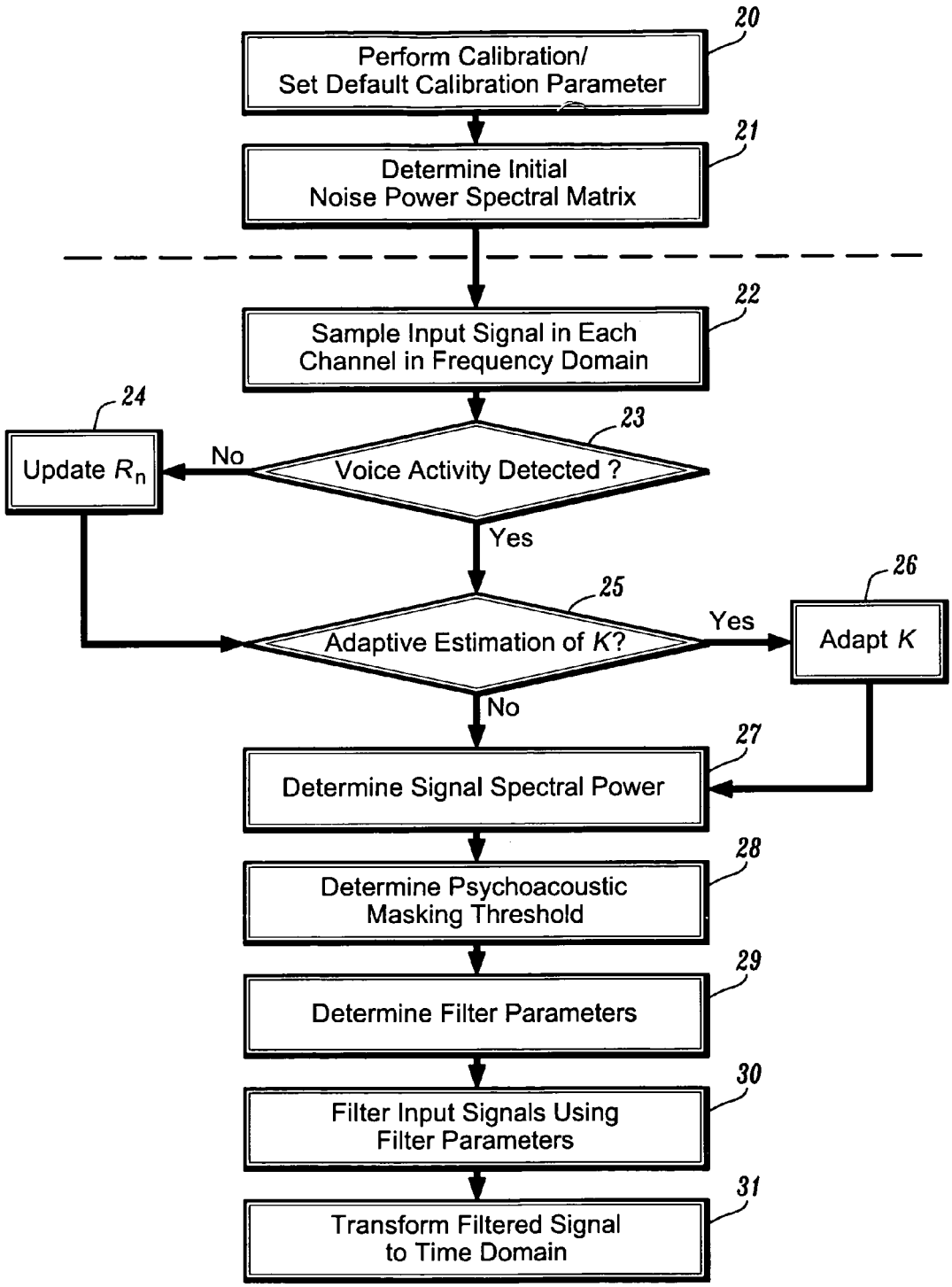
FIG. 2 is a flow diagram of a speech enhancement method according to one aspect of the present invention.

FIG. 2 is a flow diagram of a speech enhancement method according to one aspect of the present invention. For purposes of illustration, the method of FIG. 2 will be described with reference to a two-channel system, but the method of FIG. 2 is equally applicable to a multi-channel system with 3 or more channels.

In general, the method of FIG. 2 comprises two processes: (i) a calibration process whereby noise reduction parameters are estimated or set (default parameters) upon initialization of the multi-channel system; and (ii) a signal estimation process whereby the input signals in each channel are filtered to generate an enhanced signal.

During use of the speech system, a two-channel speech enhancement process according to the invention uses $X_1(w)$, $X_2(w)$, the DFT on current time frame of $x_1(t)$, $x_2(t)$ windowed by w, and an estimate of the noise spectral power matrix $R_n$ (e.g., a 2×2 matrix $R_n$=$R_{11}R_{12},R_{21}R_{22}$) to filter the input signal and generate an enhanced speech signal.

More specifically, referring now to FIG. 2, during initialization of the speech system, a calibration parameter K is determined (step 20). In one preferred embodiment, K is an estimate of the transfer function ratios between channels. K is used for filtering the input audio signal. As explained in further detail below, K may be a static parameter that is determined or set (default parameter) only at initialization, or K may be a dynamic parameter that is determined/set at initialization and then adapted during use of the system.

In particular, a calibration process can be initially performed to estimate the calibration parameter (e.g., estimate the ratio of the transfer functions of the channels). In one embodiment, this calibration process is performed by the user speaking a sentence in the absence (or a low level) of noise. Based on the two recordings, $x_1^c(t)$,$x_2^c(t)$, in accordance with one embodiment of the present invention, the constant K(w) is estimated by:

$$K(w) = \frac{\sum_{l=1}^{F} X_2^c(l,w)\overline{X_1^c(l,w)}}{\sum_{l=1}^{F} |X_1^c(l,w)|^2} \tag{7}$$

where $X_1^c(l,w)$,$X_2^c(l,w)$ represents the discrete windowed Fourier transform at frequency w, and time-frame index l of the signals $x_1^c(t)$,$x_2^c(t)$, windowed by a Hamming window w(.) of size 512 samples, for example. Other methods for performing a calibration to estimate K are described below.

Alternatively, a default parameter K may be set upon initialization of the system. In this embodiment, the calibration parameter K is predetermined based on the system design and intended use, for example. Moreover, as noted above, the calibration parameter K may be determined once at initialization and remain constant during use of the system, or an adaptive protocol may be implemented to dynamically adapt the calibration to account for, e.g., possible movement of the speech source (user) with respect to the microphone array during use of the system.

In addition, upon initialization, an initial noise spectral power matrix is determined (step 21). In one embodiment of the present invention, this initial value is preferably computed using equation (6a) with $\alpha$=1, i.e., $$R_n^{initial} = \begin{bmatrix} X_1 \\ X_2 \end{bmatrix}[\overline{X_1 X_2}].$$

Other methods for determining the initial noise spectral power matrix are described below.

After initialization of the system (e.g., steps 20 and 21), a signal estimation process is performed to enhance the user's voice signal during use of the speech system. The system samples the input signal in each channel in the frequency domain (step 22). More specifically, in the exemplary embodiment, $X_1$ and $X_2$ are computed using a windowed Fourier transform of current data $x_1$, $x_2$. During operation of the speech system, whenever voice activity is not detected in the input signal (negative determination in step 23) the noise spectral power matrix $R_n$ is updated (step 24). In accordance with one embodiment of the present invention, this update process is performed using equation (6a) (other methods for updating the noise spectral power matrix are described below). By updating $R_n$ on such basis, the efficiency of noise filtering process will be maintained at an optimal level.

In addition, if adaptive estimation of K is desired (affirmative result in step 25), the calibration parameter K will be adapted (step 26). K is dynamically updated using, for example, any of the methods described herein.

As the input signal is received and sampled (and the noise parameters updated), the signal spectral power $\rho_s$ is determined (step 27), preferably using spectral subtraction on channel one. By way of example, according to one embodiment of the present invention, the signal spectral power is determined by estimating the signal spectral power for a two-channel system as follows:

$$\rho_s = \theta(|X_1|^2 - R_{11}), \quad \theta(x) = \begin{cases} x, & \text{if } x > 0 \\ 0, & \text{otherwise} \end{cases} \tag{8}$$

Other methods for determining the signal spectral power are described below.

Next, the psychoacoustic masking threshold $R_T$ is determined using the signal spectral power, $\rho_s$ (step 28). In a preferred embodiment, the masking threshold $R_T$ is computed using the known ISO/IEC standard (see, e.g., International Standard. *Information Technology—Coding of moving pictures and associated audio for digital media up to about* 1.5 *Mbits/s—Part* 3: *Audio*. ISO/IEC, 1993).

Next, the filter parameters are determined (step 29) using the masking threshold, $R_T$, the noise spectral power matrix $R_n$, and the calibration parameter K. In a two-channel system, one method for estimating filter parameters A, B, is as follows:

$$A_o = \zeta + (R_{22} - R_{21}\overline{K})\sqrt{\frac{R_T}{(R_{11}R_{22} - |R_{12}|^2)(R_{22} + R_{11}|K|^2 - R_{12}K - R_{21}\overline{K})}} \tag{9}$$

$$B_o = (R_{11}\overline{K} - R_{12})\sqrt{\frac{R_T}{(R_{11}R_{22} - |R_{12}|^2)(R_{22} + R_{11}|K|^2 - R_{12}K - R_{21}\overline{K})}} \tag{10}$$

and then:

$$(A, B) = \begin{cases} (1, 0), & \text{if } |A_o + B_o K| > 1 \\ (A_o, B_o), & \text{otherwise.} \end{cases} \tag{11}$$

Further details of various embodiments of the filter parameter estimation process will be described hereafter.

Next, the input signals are filtered using the filter parameters to compute an enhanced signal (step 30). For example, in the exemplary two-channel framework using the above filter parameters A,B, a filtering process is as follows:

$$S = AX_1 + BX_2 \tag{12}$$

The signal S is then preferably transformed into the time domain using an overlap-add procedure using a windowed inverse discrete Fourier transform process to thus obtain an estimate for the signal s(t) (step 31).

A detailed discussion regarding the filtering process will now be presented by explaining the basis for equations 9, 10 and 11. In a preferred embodiment for a two-channel framework as described herein, a linear filter [A,B] is preferably applied on the measurements $X_1$, $X_2$. The output (estimated signal S) is computed as:

$$S = AX_1 + BX_2 = (A + BK)S + AN_1 + BN_2$$

Preferably, we would like to obtain an estimate of S that contains a small amount of noise. Let $0 \leqq \zeta_1, \zeta_2 \leqq 1$ be two given constants such that the desired signal is $w = S + \zeta_1 N_1 + \zeta_2 N_2$. Then the error $e = s - w$ has the variance:

$$R_e = |A + BK - 1|^2 \rho_s + [\,A - \zeta_1 \quad B - \zeta_2\,]\, R_n \begin{bmatrix} \overline{A} - \zeta_1 \\ \overline{B} - \zeta_2 \end{bmatrix}$$

Preferably, the filter(s) are designed such that the distortion term due to noise achieves a preset value $R_T$, the threshold masking, depending solely on the signal spectral power $p_s$. The idea is that any noise whose spectral power is below the threshold $R_T$ is unnoticed and consequently, such noise should not be completely canceled. Furthermore, by doing less noise removal, the artifacts would be smaller as well. Thus, following this premise, it is preferred that the filter achieve a noise distortion level of $R_T$. Yet, we have two unknowns (one for each channel) and one constraint ($R_T$) so far. This leaves us with one degree of freedom. We can use this degree of freedom to choose A, B that minimizes the total distortion. In one embodiment of the invention, an optimization problem for the two-channel system is:

$$\arg\min_{A,B} R_e, \text{ subject to } [\,A - \zeta_1 \quad B - \zeta_2\,]\, R_n \begin{bmatrix} \overline{A} - \zeta_1 \\ \overline{B} - \zeta_2 \end{bmatrix} = R_T \tag{14}$$

Suppose $(A_o, B_o)$ is the optimal solution. Then we validate it by checking whether $|Ao + BoK| \leqq 1$. If not, we choose not to do any processing (perhaps the noise level is already lower than the threshold, so there is no need to amplify it).

Hence:

$$(A, B) = \begin{cases} (A_o, B_o) & \text{if } |A_o + B_o K| \le 1 \\ (1, 0) & \text{if otherwise} \end{cases} \tag{15}$$

Let M(A,B) denote the expression in A, B subject to the constraint. Using the Lagrange multiplier theorem, for the lagrangian:

$$L(A,B,\lambda)=|A+BK-1|^2\,\rho_s+\Phi(A,B)+\lambda(R_T-\Phi(A,B))$$

we obtain the system:

$$\left(\rho_s\begin{bmatrix} 1 & \overline{K} \\ K & |K|^2 \end{bmatrix} - \lambda R_n\right)\begin{bmatrix} \overline{A}-\zeta_1 \\ \overline{B}-\zeta_2 \end{bmatrix} - \rho_s(1-\zeta_1-\zeta_2\overline{K})\begin{bmatrix} 1 \\ K \end{bmatrix} = 0 \tag{i}$$

$$M(A,B)=R_T \tag{ii}$$

Solving for (A,B) in the first equation (i) and inserting the expression into the second equation (ii), we obtain for 8:

$$[1 \quad \overline{K}]\left(\rho_s\begin{bmatrix} 1 & \overline{K} \\ K & |K|^2 \end{bmatrix} - \lambda R_n\right)^{-1}$$

$$R_n\left(\rho_s\begin{bmatrix} 1 & \overline{K} \\ K & |K|^2 \end{bmatrix} - \lambda R_n\right)^{-1}$$

$$\begin{bmatrix} 1 \\ K \end{bmatrix} = \frac{R_T}{\rho_s^2|1-\zeta_1-\zeta_2 K|^2}$$

Using the Matrix Inversion Lemma (see, e.g., D. G. Manolakis, et al., "Statistical and Adaptive Signal Processing", McGraw Hill Series in Electrical and Computer Engineering, Appendix A, 2000), the equation in 8 becomes:

$$\lambda = \rho_s\frac{R_{22}+R_{11}|K|^2-R_{12}K\,R_{21}\overline{K}}{R_{11}R_{22}-|R_{12}|^2} \pm \rho_s|1-\zeta_1-\zeta_2 K|\sqrt{\frac{R_{22}+R_{11}|K|^2-R_{12}K-R_{21}\overline{K}}{R_T(R_{11}R_{22}-|R_{12}|^2)}}. \tag{16}$$

Replacing in Re, we obtain:

$$R_e = R_T + \rho_s|1-\zeta_1-\zeta_2 K|^2\left|1 \pm \frac{1}{|1-\zeta_1-\zeta_2 K|}\sqrt{\frac{R_T(\overline{R_{22}+R_{11}|K|^2-R_{12}K-R_{21}K})}{R_{11}R_{22}-|R_{12}|^2}}\right|^2$$

Hence the optimal solution is the one with—in equation (16). Consequently, the optimizer becomes:

$$A_o = \zeta_1 - (R_{22}-R_{21}\overline{K})\arg(\zeta_1+\zeta_2 K-1)\sqrt{\frac{R_T}{(R_{11}R_{22}-|R_{12}|^2)(R_{22}+R_{11}|K|^2-R_{12}K-R_{21\overline{K}})}} \tag{17}$$

$$B_o = \zeta_2 - (R_{11}\overline{K}-R_{12})\arg(\zeta_1+\zeta_2 K-1)\sqrt{\frac{R_T}{(R_{11}R_{22}-|R_{12}|^2)(R_{22}+R_{11}|K|^2)-R_{12}K-R_{21\overline{K}})}} \tag{18}$$

The more practical form is obtained for $\zeta_1=\zeta$ and $\zeta_{21}=0$. Then:

$$A_o = \zeta + (R_{22}-R_{21}\overline{K})\sqrt{\frac{R_T}{(R_{11}R_{22}-|R_{12}|^2)(R_{22}+R_{11}|K|^2-R_{12}K-R_{21\overline{K}})}} \tag{19}$$

and $$B_o = (R_{11}\overline{K}-R_{12})\sqrt{\frac{R_T}{(R_{11}R_{22}-|R_{12}|^2)(R_{22}+R_{11}|K|^2-R_{12}K-R_{21\overline{K}})}} \tag{20}$$

which are exactly equations 9–11.

Further embodiments of a multi-channel noise reduction system according to the present invention will now be described in detail. In a D-channel framework wherein D microphone signals, $x_1(t), \ldots, x_D(t)$, record a source s(t) and noise signal, $n_1(t), \ldots, x_D(t)$, a mixing model according to another embodiment of the present invention is preferably defined as follows:

$$x_1(t) = \sum_{k=0}^{L_1} a_k^1 s(t-\tau_k^1) + n_1(t) \tag{21}$$

$$x_D(t) = \sum_{k=0}^{L_D} a_k^D s(t-\tau_k^D) + n_D(t)$$

where the terms $(a_k^1, \tau_k^1)$ denote the attenuation and delay on the $k^{th}$ path to microphone L. In the frequency domain, the convolutions become multiplications. Furthermore, since we are not interested in balancing the channels, we redefine the source so that the first channel becomes unity:

$$X_1(k,w)=S(k,w)+N_1(k,w)$$

$$X_2(k,w)=K_2(w)S(k,w)+N_2(k,w) \tag{22}$$

$$\ldots$$

$$X_D(k,w)=K_D(w)S(k,w)+N_D(k,w)$$

wherein k denotes the frame index and w denotes the frequency index. More compactly, the model can be rewritten as:

$$X=KS+N \tag{23}$$

where X, K, S. and N are D-complex vectors. With this model, the following assumptions are made:

1. The transfer function ratios $K_1$ are known;
2. S(w) are zero-mean stochastic processes with spectral power $\rho_s(w)=E[|S|^2]$;
3. $(N_1, N_2, \ldots, N_D)$ is a zero-mean stochastic signal with the following spectral covariance matrix:

$$R_n(w) = \begin{bmatrix} E[|N_1|^2, E[N_1\overline{N_2}], \ldots, E[N_1\overline{N_D}] \\ E[N_2\overline{N_1}], E[|N_2|^2, \ldots, E[N_2\overline{N_D}] \\ \ldots \\ E[N_D\overline{N_1}], E[N_D\overline{N_2}], \ldots, E[|N_D|^2] \end{bmatrix}; \text{ and} \tag{24}$$

4. S is independent of n.

A detailed discussion of methods for estimating K, $\Delta_s$ and $R_n$ according to embodiments of the invention will be described below.

In the multi-channel embodiment with D channels, preferably, a linear filter:

$$A=[A_1\ A_2\ A_D] \tag{25}$$

is applied to the measured signals $X_1, X_2, \ldots X_D$. The output of the filter is:

$$Y=\sum_{l=1}^{D} A_l X_l = AKS + AN. \tag{26}$$

The goal is to obtain an estimate of S that contains a small amount of noise. Assume that $0 \leqq \zeta_1, \ldots, \zeta_D \leqq 1$ are constants such that the desired signal is $w=S+\zeta_1 N_1+\zeta_2 N_2+\ldots+\zeta_D N_D$. Then the error $e=s-w$ has the variance $R_e=|AK-1|^2\rho_s+(A-\zeta)R_n(A^*-\zeta^T)$ where $\zeta=[\zeta_1, \ldots, \zeta_M]$ is a 1×M vector of desired levels of noise. As explained above, it is preferable that the filter achieve a noise distortion level of $R_T$. The D-1 degrees of freedom are used to choose A that minimizes the total distortion. Preferably, the optimization problems becomes:

$$\arg\min_A R_e, \text{ subject to } (A-\zeta)R_n(A^*-\zeta^T)=R_T \tag{27}$$

Assuming $A_o$ denotes an optimal solution, then we validate it by checking whether $|A_o K| \leqq 1$. If not, no processing is performed because the noise level is lower than the threshold and there is no reason to amplify it. Therefore:

$$A=\begin{cases} A_o & \text{if } |A_o K| \leq 1 \\ (1, 0, \ldots, 0) & \text{if otherwise.} \end{cases} \tag{28}$$

Setting $B=A-\zeta$, and constructing the Lagrangian:

$L(B,\lambda)=|BK+\zeta K-1|^2\rho_s+BR_nB^*+\lambda(BR_nB^*-R_T)$, we obtain the system:

$$K^*(BK+\zeta K-1)\rho_s+BR_n+\lambda BR_n=0$$

$$K(K^*B^*+B^*\zeta^T-1)\rho_s+R_nB^*+\lambda R_nB^*=0$$

$$BR_nB^*-R_T=0$$

Solving for B in the first equation and inserting the expression into the second equation, we obtain with $\mu=(1+\lambda)/\rho_s$, the threshold:

$$RT=|1-\zeta K|^2K^*(\mu R_n+KK^*)^{-1}R_n(\mu R_n+KK^*)^{-1}K$$

Using the Inversion Lemma (see, e.g., S. V. Vaseghi, Advanced Digital Signal Processing and Noise Reduction, John Wiley & sons, 2nd Edition, 2000), the equation in : becomes:

$$\mu = -K^* R_n^{-1} K \pm |1-\zeta K| \sqrt{\frac{K^* R_n^{-1} K}{R_T}}. \tag{29}$$

Replacing in Re, we obtain:

$$R_e=R_T+\rho_s|\pm\sqrt{R_T(K^*R_n^{-1}K)}-|1-\zeta K||^2.$$

Hence, the optimal solution is the solution with "+" in equation (29). Consequently, the optimizer becomes:

$$A_o = \zeta + \frac{1-\zeta K}{|1-\zeta K|}\sqrt{\frac{R_T}{K^* R_n^{-1} K}}\ K * R_n^{-1}. \tag{30}$$

A more practical form is obtained for $\zeta_1=\zeta$ and $\zeta_k=0$, k>1.

Then:

$$A_o = (\zeta, 0, \ldots, 0) + \sqrt{\frac{R_T}{K^* R_n^{-1} K}}\ K * R_n^{-1} \tag{31}$$

and $$|A_0 K|=\zeta+\sqrt{r_T(K^*R_n^{-1}K)}.$$

The following is a detailed description of other preferred methods for estimating the transfer function ratios K and spectral power densities Δs and Rn according to the invention. It is assumed that an ideal VAD signal is available. For example, in accordance with the present invention, there are various methods for estimating K that may be implemented: (i) an ideal estimator of K done through a subspace method; (ii) a non-parametric estimator using a gradient algorithm; and (iii) a model-based estimator using a gradient algorithm. The ideal estimator can be thought of as an initialization of an adaptive procedure, whereas the non-parametric and model-based estimators can be used to adapt K blindly.

Ideal Estimator of K: Assume that a set of measurements are made under quiet conditions with the user speaking, wherein $x_1(t), \ldots, x_D(t)$ denotes such measurements and wherein $X_1(k,w), \ldots, X_D(k,w)$ denote the time-frequency domain transform of such signals. Assuming that the only noise is microphone noise (hence independence among channels) is recorded, the noise spectral power covariance in equation (24) is $R_n(w)=\sigma_n^2(w)I_D$ which turns the measured signal long-term spectral power density (i.e., time-averaged) into:

$$R_x(w)=\rho_s(w)KK^*+\sigma_n^2(w)I_D. \tag{32}$$

This suggest a subspace method to estimate K. Indeed, K is the eigenvector of Rx corresponding to the largest eigenvalue $\lambda_{max}=\rho_s\|K\|^2+\sigma_n^2$. Thus, K is preferably estimated by first computing the long term spectral covariance matrix Rx, and then determining K as the eigenvector corresponding to the largest eigenvalue of Rx.

Adaptive Non-Parametric Estimator of K

Assuming that the measurements $x_1 \ldots, x_D$ contain signal and noise (equation (21)). Assume further that we have estimates of the noise spectral power $R_n$, the signal spectral power $\Delta_s$, and an estimate of K' that we want to update. The measured signal (short-time) spectral power $R_x(k,w)$ is:

$$R_x(k,w)=\rho_s(k,w)KK^*+R_n(k,w) \tag{33}$$

We want to update K to $K'=K+\Delta K$ constrained by $\|\Delta K\|$ small, and $\Delta K=[0\Lambda]^T$, where $\Lambda=[\Delta K_2 \ldots \Delta K_D]$, which best fits equation (33) in some norm, preferably the Frobenius norm, $\|A\|_F^2=\text{trace}\{AA^*\}$. Then the criterion to minimize becomes:

$$J(X)=\text{tracer}\{(R_x-R_n-\rho_s(K+[0\Lambda]^T)(K+[0\Lambda]^T)^*)^2\} \tag{34}$$

The gradient at Λ=0 is:

$$\left.\frac{\partial J}{\partial \Lambda}\right|_0 = -2\rho_s(K^*E)_r \tag{35}$$

where the index r truncates the vector by cutting out the first component: for $\nu=[\nu_1\nu_2 \ldots \nu_D]$, $\nu_r=[\nu_2 \ldots \nu_D]$, and $E=R_x-R_n-\rho_s KK^*$. Thus the gradient algorithm for K gives the following adaptation rule:

$$K'=K+[0\Lambda]^T,\ \Lambda=\alpha\rho_s(K^*E)_r \tag{36}$$

where $0<\alpha<1$ is the learning rate.

Adaptive Model-based Estimator of K

Another adaptive estimator according to the present invention makes use of a particular mixing model, thus reducing the number of parameters. The simplest but fairly efficient model is a direct path model:

$$K_l(w)=a_l e^{iw\delta_l},\ l\geqq 2 \tag{37}$$

In this case, a similar criterion to equation (34) is to be minimized, in particular:

$$I(a2,\ldots,aD,\delta 2,\ldots,\delta D)=\sum_w \text{trace}\{(R_x-R_n-\rho_s KK^*)^2\} \tag{38}$$

Note the summation across the frequencies because the same parameters $(a_l,\delta_l)_{2\leqq l\leqq D}$ have to explain all the frequencies. The gradient of I evaluated on the current estimate $(a_l,\delta_l)_{2\leqq l\leqq D}$ is:

$$\frac{\partial I}{\partial a_l}=-4\sum_w \rho_s\cdot\text{real}(K*Ev_l) \tag{39}$$

$$\frac{\partial I}{\partial a_l}=-2a_l\sum_w w\rho_s\cdot imag(K*Ev_l) \tag{40}$$

where $E=R_x-R_n-\rho_s KK^*$ and $v_l$ the D-vector of zeros everywhere except on the $l^{th}$ entry where it is $e^{iw\delta_l}$, $v_l=[0\ldots 0e^{iw\delta_l}0\ldots 0]^T$. Then, the preferred updating rule is given by:

$$a_l'=a_l-\alpha\frac{\partial I}{\partial a_l} \tag{41}$$

$$\delta_l'=\delta_l-\alpha\frac{\partial I}{\partial \delta_l} \tag{42}$$

where 0]∀]1;

Estimation of Spectral Power Densities

In accordance with another embodiment of the present invention, the estimation of $R_n$ is computed based on the VAD signal as follows:

$$R_n^{new}=\begin{cases}(1-\beta)R_n^{old}+\beta XX^* & \text{if voice not present}\\ R_n^{old} & \text{if otherwise}\end{cases} \tag{43}$$

where ℬ is a learning curve (equation 43 is similar to equation (6a)).

The measured signal spectral power Rx is then estimated from the measured input signals as follows:

$$R_x^{new}=(1-\alpha)R_x^{old}+\alpha XX^* \tag{43a}$$

where 𝒜 is a learning rate, preferably equal to 0.9.

Preferably, the signal spectral power, $\Delta_s$, is estimated through spectral subtraction, which is sufficient for psychoacoustic filtering. Indeed, the signal spectral power, $\Delta_s$, is not used directly in the signal estimation (e.g., Y in equation (26)), but rather in the threshold $R_T$ evaluation and K updating rule. As for the K update, experiments have shown that a simple model, such as the adaptive model-based estimator of equation (37) yields good results, where $\Delta_s$ plays a relatively less significant role. Accordingly, according to another embodiment of the present invention, the spectral signal power is estimated by:

$$\rho_s=\begin{cases}R_{x;11}-R_{n;11} & \text{if } R_{x;11}>\beta_{ss}R_{n;11}\\ (\beta_{ss}-1)R_{n;11} & \text{if otherwise}\end{cases} \tag{44}$$

where ∃ss>1 is a floor-dependent constant. By using ∃ss, even when voice is not present, we still determine the signal spectral power to avoid clipping of the voice, for example. In a preferred embodiment, ∃ss=1.1.

Exemplary Embodiment

Figure 3A:
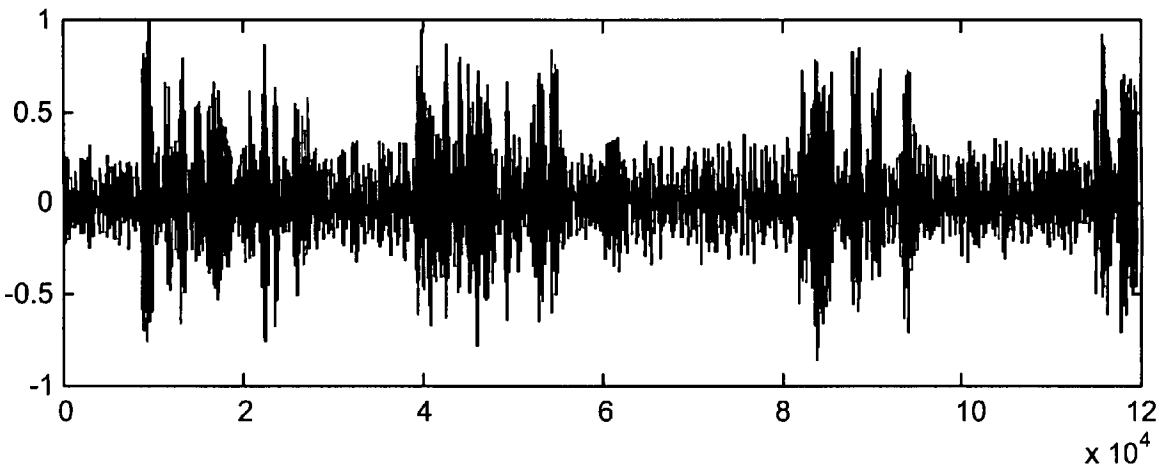
FIGS. 3*a* and 3*b* are diagram illustrating exemplary input waveforms of a first and second channel, respectively, in a two-channel speech enhancement system according to the present invention.
Figure 3B:
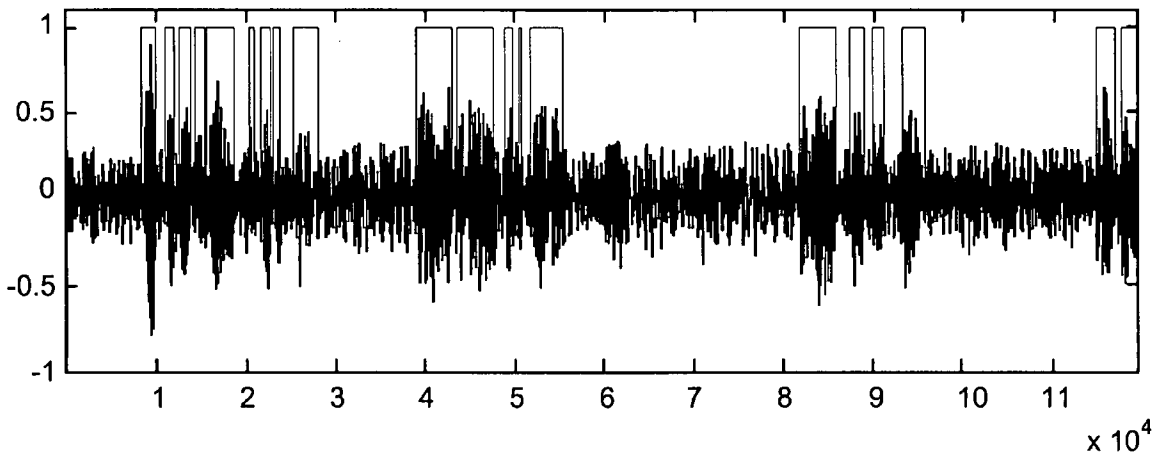
Figure 3C:
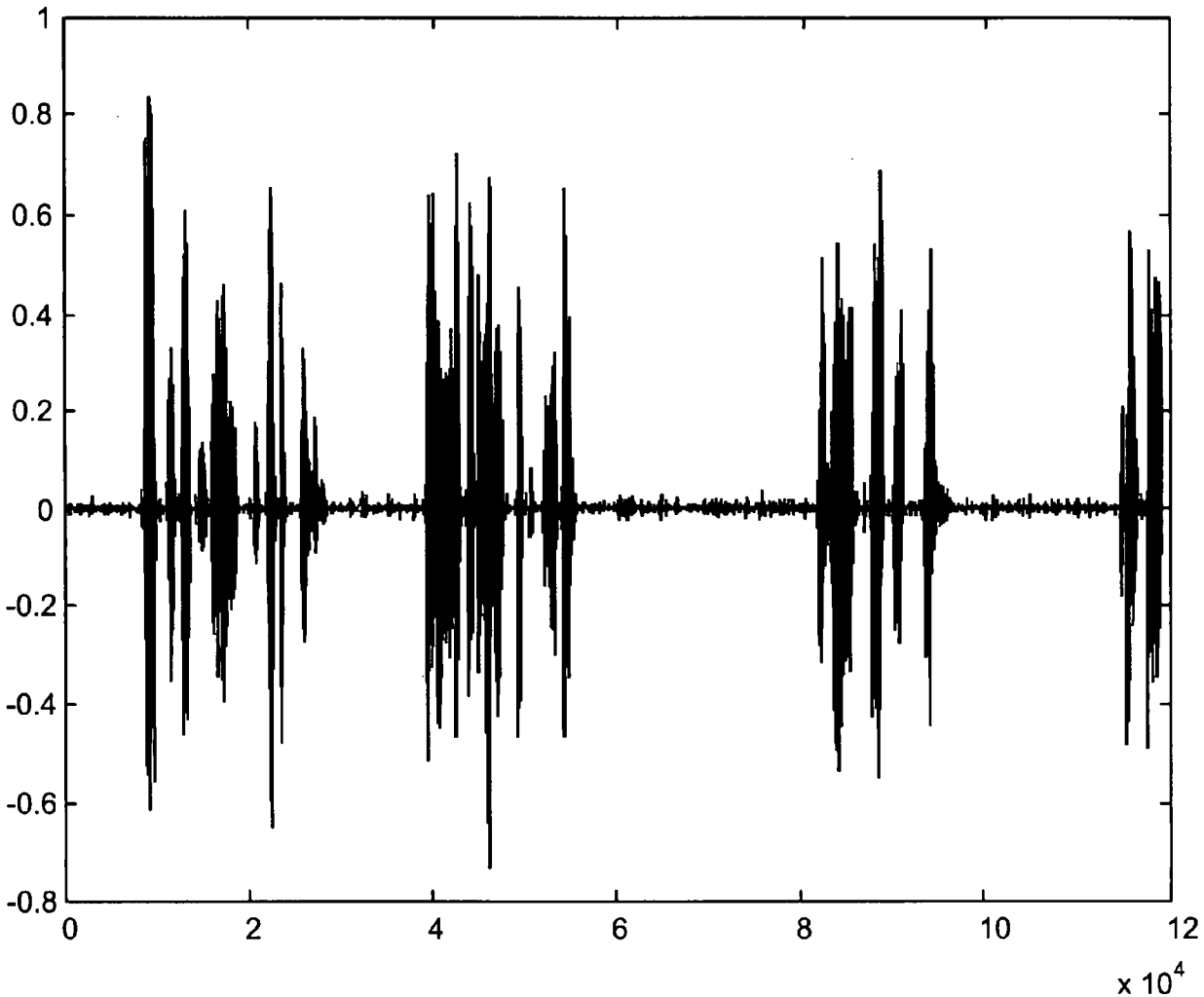
FIG. 3*c* is an exemplary diagram of the output waveform of a two-channel speech enhancement system according to the present invention.

To assess the performance of a two-channel framework using the algorithms described herein, stereo recordings for two microphones were captured in noisy car environment (−6.5 dB overall SNR on average), at a sampling frequency of 8 HHz. Exemplary waveforms for a two-channel system are shown in FIGS. 3*a*, 3*b* and 3*c*. FIG. 3*a* illustrates the first channel waveform and FIG. 3*b* illustrates the second channel waveform with the VAD decision superimposed thereon. FIG. 3*c* illustrates the filter output.

For the experiment, a time-frequency analysis was performed by using a Hamming window of size 512 samples with 50% overlap, and the synthesis by overlap-add procedure. $R_x$ was estimated by a first-order filter with learning rate 𝒜=0.9 (equation (43a)). In addition, the following parameters were applied: $\exists_{ss}$=1.1 (equation (44)); ∃=0.2 (equation (43)); .=0.001 (equation (30)); and ∀=0.01 (equations 36, or 42).

The two-channel psychoacoustic noise reduction algorithm was applied on a set of two voices (one male, one female) in various combinations with noise segments from two noise files.

Two-channel experiments show considerably lower distortion on average as compared to the single-channel system (as in Gustafsson et al., idem), while still reducing noise. Informal listening tests have confirmed these results. The two-channel system output signal had little speech distortion and noise artifacts as compared to the mono system. In addition, the blind identification algorithms performed fairly well with no noticeable extra degradation of the signal.

In conclusion, the present invention provides a multi-channel speech enhancement/noise reduction system and method based on psychoacoustic masking principles. The optimality criterion satisfies the psychoacoustic masking principle and minimizes the total signal distortion. The experimental results obtained in a dual channel framework on very noisy data in a car environment illustrate the capabilities and advantages of the multi-channel psychoacoustic system with respect to SNR gain and artifacts.

Although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention. All such changes and modifications are intended to be included within the scope of the invention as defined by the appended claims.

What is claimed is:

1. A method for filtering noise from an audio signal, comprising the steps of:

obtaining a multi-channel recording of an audio signal contained in input channels;

determining a psychoacoustic masking threshold for the audio signal;

determining a noise spectral power matrix for the audio signal;

determining parameters of a filter for filtering noise from the audio signal using the multi-channel recording, wherein the filter parameters are determined using the determined psychoacoustic masking threshold and using the determined noise spectral power matrix;

filtering the multi-channel recording using the filter having the determined parameters to generate an enhanced audio signal; and determining a calibration parameter for the input channels, wherein the calibration parameter comprises a ratio of the impulse responses of different channels, and wherein the calibration parameter is used to determine the filter parameters, wherein the step of determining the calibration parameter comprises processing channel noise recorded in the different channels to determine a long-term spectral covariance matrix, and determining an eigenvector of the long-term spectral covariance matrix corresponding to a desired eigenvalue.

2. The method of claim 1, wherein the calibration parameter is determined by processing a speech signal recorded in the different channels under quiet conditions.

3. The method of claim 1, wherein the step of determining the calibration parameter is performed using an adaptive process.

4. The method of claim 3, wherein the adaptive process comprises a blind adaptive process.

5. The method of claim 1, wherein the step of determining the calibration parameter further comprises setting a default calibration parameter.

6. The method of claim 1, further comprising the step of:

determining the signal spectral power using the determined noise spectral power matrix, wherein the signal spectral power is used to determine the masking threshold.

7. The method of claim 6, further comprising the steps of:

detecting speech activity in the audio signal; and updating the noise spectral power matrix at times when speech activity is not detected in the audio signal.

8. The method of claim 1 wherein the filter comprises a linear filter.

9. A method for filtering noise from an audio signal, comprising steps of:

obtaining a multi-channel recording of an audio signal;

determining a psychoacoustic masking threshold for the audio signal;

determining a noise spectral power matrix for the audio signal;

determining parameters of a filter for filtering noise from the audio signal using the multi-channel recording, wherein the filter parameters are determined using the determined psychoacoustic masking threshold and using the determined noise spectral power matrix;

filtering the multi-channel recording using the filter having the determined parameters to generate an enhanced audio signal; and determining a calibration parameter for the input channels, wherein the calibration parameter comprises a ratio of the impulse responses of different channels, wherein the calibration parameter is used to determine the filter parameters, wherein the step of determining the calibration parameter is performed using an adaptive process, and wherein the adaptive process comprises a non-parametric estimation process using a gradient algorithm.

10. A method for filtering noise from an audio signal, comprising steps of:

obtaining a multi-channel recording of an audio signal;

determining a psychoacoustic masking threshold for the audio signal;

determining a noise spectral power matrix for the audio signal;

determining parameters of a filter for filtering noise from the audio signal using the multi-channel recording, wherein the filter parameters are determined using the determined psychoacoustic masking threshold and using the determined noise spectral power matrix;

filtering the multi-channel recording using the filter having the determined parameters to generate an enhanced audio signal; and determining a calibration parameter for the input channels, wherein the calibration parameter comprises a ratio of the impulse responses of different channels, wherein the calibration parameter is used to determine the filter parameters, wherein the step of determining the calibration parameter is performed using an adaptive process, and wherein the adaptive process comprises a model-based estimation process using a gradient algorithm.

11. A program storage device readable by a machine, tangibly embodying a program of instructions executable by the machine to perform method steps for filtering noise from an audio signal, the method steps comprising:

obtaining a multi-channel recording of an audio signal;

determining a noise spectral power matrix of the audio signal;

determining a psychoacoustic masking threshold for the audio signal;

determining parameters of a filter for filtering noise from the audio signal using the multi-channel recording, wherein the filter parameters are determined using the determined psychoacoustic masking threshold and using the determined noise spectral power matrix;

filtering the multi-channel recording using the filter having the determined parameters to generate an enhanced audio signal; and providing instructions for performing the steps of determining a calibration parameter for the input channels, wherein the calibration parameter comprises a ratio of the impulse responses of different channels, and wherein the calibration parameter is used to determine the filter parameters, wherein the instructions for determining the calibration parameter comprise instructions for performing the steps of processing channel noise recorded in the different channels to determine a long-term spectral covariance matrix, and determining an eigenvector of the long-term spectral covariance matrix corresponding to a desired eigenvalue.

12. The program storage device of claim 11, wherein the calibration parameter is determined by processing a speech signal recorded in the different channels under quiet conditions.

13. The program storage device of claim 11, wherein the instructions for determining the calibration parameter comprise instructions for determining the calibration parameter using an adaptive process.

14. The program storage device of claim 13, wherein the adaptive process comprises a blind adaptive process.

15. The program storage device of claim 11, wherein the instructions for determining the calibration parameter further comprise instructions for setting a default calibration parameter.

16. The program storage device of claim 11, further comprising instructions for performing the step of:

determining the signal spectral power using the determined noise spectral power matrix, wherein the signal spectral power is used to determine the masking threshold.

17. The program storage device of claim 16, further comprising instructions for performing the steps of:

detecting speech activity in the audio signal; and updating the noise spectral power matrix at times when speech activity is not detected in the audio signal.

18. The program storage device of claim 11, wherein the filter comprises a linear filter.

19. A program storage device readable by a machine, tangibly embodying a program of instructions executable by the machine to perform method steps for filtering noise from an audio signal, the method steps comprising:

obtaining a multi-channel recording of an audio signal;

determining a noise spectral power matrix of the audio signal;

determining a psychoacoustic masking threshold for the audio signal;

determining parameters of a filter for filtering noise from the audio signal using the multi-channel recording, wherein the filter parameters are determined using the determined psychoacoustic masking threshold and using the determined noise spectral power matrix;

filtering the multi-channel recording using the filter having the determined parameters to generate an enhanced audio signal; and providing instructions for performing the steps of determining a calibration parameter for the input channels, wherein the calibration parameter comprises a ratio of the impulse responses of different channels, wherein the calibration parameter is used to determine the filter parameters, wherein the instructions for determining the calibration parameter comprise instructions for determining the calibration parameter using an adaptive process, and wherein the adaptive process comprises a non-parametric estimation process using a gradient algorithm.

20. A program storage device readable by a machine, tangibly embodying a program of instructions executable by the machine to perform method steps for filtering noise from an audio signal, the method steps comprising:

obtaining a multi-channel recording of an audio signal;

determining a noise spectral power matrix of the audio signal;

determining a psychoacoustic masking threshold for the audio signal;

determining parameters of a filter for filtering noise from the audio signal using the multi-channel recording, wherein the filter parameters are determined using the determined psychoacoustic masking threshold and using the determined noise spectral power matrix;

filtering the multi-channel recording using the filter having the determined parameters to generate an enhanced audio signal; and providing instructions for performing the steps of determining a calibration parameter for the input channels, wherein the calibration parameter comprises a ratio of the impulse responses of different channels, wherein the calibration parameter is used to determine the filter parameters, wherein the instructions for determining the calibration parameter comprise instructions for determining the calibration parameter using an adaptive process, and wherein the adaptive process comprises a model-based estimation process using a gradient algorithm.

21. A system for reducing noise of an audio signal, comprising:

an audio capture system comprising a microphone array for capturing and recording an audio signal contained in input channels obtained from the microphone array; and a front-end speech processor that determines a psychoacoustic masking threshold of the audio signal and a noise spectral power matrix of the audio signal and that generates an enhanced speech signal of the audio signal by filtering noise from the speech signal using the psychoacoustic masking threshold and the noise spectral power matrix, wherein the front-end speech processor comprises:

a sampling module for generating a time-frequency representation of an audio signal in each of the input channels;

a calibration module for determining a calibration parameter, the calibration parameter comprising a ratio of the transfer functions between different channels;

a voice activity detection module for detecting a speech signal in the input audio signal;

a filter module for determining filter parameters using the psychoacoustic masking threshold, the noise spectral power matrix, and the calibration parameter;

a filter for filtering the multi-channel recording using the filter parameters to generate an enhanced signal; and a conversion module for converting the enhanced signal into a time domain representation, wherein the ratio of transfer functions is based on the impulse responses of the different channels and the calibration parameter is determined by processing channel noise recorded in the different channels to determine a long-term spectral covariance matrix, and determining an eigenvector of the long-term spectral covariance matrix corresponding to a desired eigenvalue.

22. The system of claim 21, further comprising:

a signal spectral power module for determining the signal spectral power using the noise spectral power matrix, wherein the signal spectral power is used to determine the masking threshold.

* * * * *